US007129842B2

(12) United States Patent
Hope

(10) Patent No.: US 7,129,842 B2
(45) Date of Patent: Oct. 31, 2006

(54) MEMS SENSOR UNIT FOR SECURITY APPLICATIONS

(75) Inventor: Gordon G. Hope, Miller Place, NY (US)

(73) Assignee: Honeywell International, Inc., Morristown, NJ (US)

( * ) Notice: Subject to any disclaimer, the term of this patent is extended or adjusted under 35 U.S.C. 154(b) by 155 days.

(21) Appl. No.: 10/995,624

(22) Filed: Nov. 23, 2004

(65) Prior Publication Data

US 2006/0119476 A1 Jun. 8, 2006

(51) Int. Cl.
*G08B 12/14* (2006.01)

(52) U.S. Cl. ..... 340/568.1; 340/539.1; 340/539.13; 340/686.6; 340/689; 340/10.1; 701/207

(58) Field of Classification Search ..... 340/568.1, 340/568.2, 571, 572.1, 539.1, 539.13, 539.16, 340/539.23, 825.36, 825.49, 7.25, 540, 669–671, 340/689, 686.1, 686.6, 10.1, 10.33; 701/207, 701/220

See application file for complete search history.

(56) References Cited

U.S. PATENT DOCUMENTS 6,512,478 B1 * 1/2003 Chien ..... 342/357.09
6,731,198 B1 * 5/2004 Stobbe et al. ..... 340/10.33
7,026,941 B1 * 4/2006 Anderson ..... 340/573.1
7,038,584 B1 * 5/2006 Carter ..... 340/539.13
7,053,764 B1 * 5/2006 Stilp ..... 340/506

OTHER PUBLICATIONS

"How they work, MES (Micro Electro-Mechanical Systems) Technology", http://www.sensorland.com/HowPage023.html, dated Nov. 11, 2004.

Speller, et al., "A low-noise MEMS accelerometer for unattended ground sensor applications", www.appliedmems.com, dated Nov. 11, 2004.

* cited by examiner

*Primary Examiner*—Davetta W. Goins
(74) *Attorney, Agent, or Firm*—Scully, Scott, Murphy & Presser, P.C

(57) ABSTRACT

A MEMS (micro-electronic mechanical system) sensor unit is described for wireless security applications that provides an extended battery life for the MEMS sensor unit, to provide both immediate MEMS motion detection, and also an "out of range" detection capability when the MEMS sensor unit is moved beyond the range of a security system receiver, providing both capabilities without an unacceptable reduction in battery life for the MEMS sensor unit.

15 Claims, 1 Drawing Sheet

MEMS SENSOR UNIT FOR SECURITY APPLICATIONS

BACKGROUND OF THE INVENTION

1. Field of Invention

The present invention relates generally to a MEMS (micro-electronic mechanical system) sensor unit for wireless security applications that provides an extended battery life for the MEMS sensor unit, to provide both immediate MEMS motion detection, and also an "out of range" detection capability when the MEMS sensor unit is moved beyond the range of a security system receiver, providing both capabilities without an unacceptable reduction in battery life for the MEMS sensor unit.

2. Discussion of the Prior Art

Prior art wireless security systems have protected valuable assets by attaching to each asset a battery powered security tag that periodically transmits a short range security RF signal to a security system receiver that monitors the signals within a protected safe area defined by the range within which the security system receiver can normally receive and detect the short range signals transmitted by the security tag. The range that a security system receiver can normally receive and detect transmitted short range RF signals is typically 200 to 300 feet within a building and can extend up to one mile over open space. A typical prior art security system can include several different receivers strategically placed around a security area being protected The security system assumes that the asset is safe as long as the security system receiver continues receiving the periodically transmitted security signals, and assumes an alarm condition when the security system receiver stops receiving the periodically transmitted security signals.

MEMS sensors are generally used in the prior art to measure and indicate motion immediately as the sensors are moved in one or more directions. In a wireless security system, a battery powered unit including a MEMS sensor and a transmitter can be attached to a valuable object to be protected, and when the MEMS sensor detects that the object is being moved, the unit transmits a wireless short range RF signal to a security system receiver. For broader applications in the security industry, an ideal MEMS sensor unit would provide immediate MEMS motion detection, and also provide an "out of range" detection capability when the MEMS sensor unit is moved beyond the range of the security system receiver. In this second "out of range" application, a logical way to provide a notification to the security system is for the MEMS sensor unit to transmit signals on a frequent periodic basis, such as on a periodic basis of once every minute. In such an arrangement, the battery life of the transmitter would be severely diminished, and the reduced battery life would not be acceptable in many different security situations. The present invention provides a solution whereby both applications can be met without an unacceptable reduction in battery life for the MEMS sensor unit.

SUMMARY OF INVENTION

The present invention provides a dual purpose MEMS sensor unit for a security system that provides both an immediate alarm signal upon detection of motion as well as an "out of range" condition or capability to provide broader application and coverage for the MEMS sensor unit. The MEMS sensor provides a motion signal when it is initially moved as a trigger for the device to start transmitting at short intervals, and returns to much longer duration intervals after the MEMS sensor comes to rest.

The MEMS sensor unit preferably comprises a battery power supply, a MEMS sensor, a short range RF transmitter, and a controller to control operation of the MEMS sensor unit. Initially the MEMS sensor unit is in a power conservation, normal supervision mode in which it transmits a normal status RF signal to the security system receiver on an infrequent normal supervision interval. Upon sensing motion, the MEMS sensor unit transmits a motion signal to the security system receiver indicating that it has been moved, and then sends supervision signals to the security system receiver on a more frequent interval than the normal supervision interval. After the MEMS sensor unit senses that it has returned to a stationary state, it transmits a stationary signal to the security system receiver indicating the return to a stationary state. The MEMS sensor unit then returns to the normal supervision mode, transmitting the normal status signal on an infrequent normal supervision interval. If the MEMS sensor unit is moved out of range of the security system receiver before the stationary message is received by the security system receiver, as indicated by the security system receiver not receiving one or more of the frequent supervision signals, the security control system indicates an alarm condition.

In greater detail, the MEMS sensor unit can transmit the normal status RF signal to the RF receiver on an infrequent normal supervision interval of approximately once every hour, and can transmit the supervision signals to the RF receiver on a more frequent interval of approximately once every minute. The controller is programmable to allow an installer to set different sensitivity levels or different transmission intervals for the MEMS sensor unit. The security system has an armed state and an unarmed state, and the security system triggers an alarm condition differently depending upon its present armed or unarmed state. The MEMS sensor unit measures motion and the rate of change of motion along one or more axes, and the time duration of the motion, to provide different levels of security dependent upon the type of and duration of the motion.

BRIEF DESCRIPTION OF THE DRAWINGS

The foregoing objects and advantages of the present invention for a MEMS sensor for security applications may be more readily understood by one skilled in the art with reference to the following detailed description of several embodiments thereof, taken in conjunction with the accompanying drawings wherein like elements are designated by identical reference numerals throughout the several views, and in which.

DETAILED DESCRIPTION OF THE INVENTION

Figure 1:
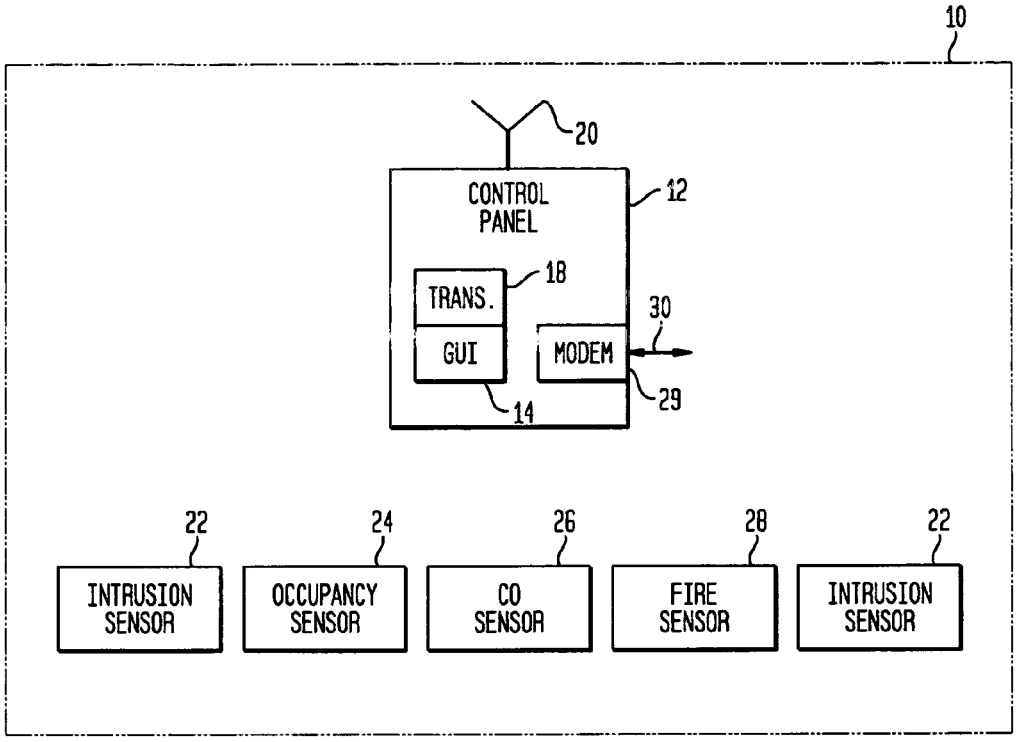
FIG. 1 illustrates a typical security system for a commercial or residential premises that typically comprises a security system control panel that provides a display of information on the complete status of the security system, such as a display of pertinent parameters and conditions of the security system.

FIG. 1 illustrates a typical security system for a commercial or residential premises 10 that typically comprises a security system control panel 12 provided at a central accessible location, such as just inside the front entrance of the premises protected by the security alarm system. The control panel provides a display 14 of information on the complete status of the security system, such as a display of pertinent parameters and conditions of the security system.

The control panel also enables a person to control operation of the security system, such as arming or disarming of the security system by entry of a proper security code and of specific commands. The control panel might include a GUI display (graphical user interface) 14 to enable a user to view the status of the security alarm system and also to enter data into and access and control the security system.

The security system is a wireless system, and the control panel also includes an RF transceiver 18 and antenna 20 to transmit and receive RF transmitted data, with many of the communications between the sensors and the control panel being by short range RF communication messages.

A typical commercial or residential security system also includes a plurality of intrusion security sensors 22 mounted at doors and windows to detect any intrusions thereat, and motion/occupancy sensors 24 mounted at strategic locations in the premises to detect the presence of a person thereat, which are connected by security system wiring or short range RF transmissions to the security system control panel. A typical security system might also include one or more CO sensors 26 and smoke or fire sensors 28 mounted at strategic locations in the premises to detect any of those conditions, with those sensors also being connected by security system wiring or short range RF transmissions to the security system control panel. The security system control panel monitors signals from the security system sensors to determine the status of the security system.

A typical commercial or residential security system might also include a modem 29 and a telephone line or cable connection to allow bidirectional data communications over telephone lines and/or a cable system and/or the internet, as indicated schematically at 30.

The present invention provides a dual purpose MEMS sensor unit for a security system such as illustrated in FIG. 1 that provides both an immediate alarm signal upon detection of motion as well as an "out of range" condition or capability to provide broader application and coverage for the MEMS sensor unit. The MEMS sensor unit provides a motion signal when it initially senses movement as a trigger for the device to start transmitting at relatively short intervals, such as one minute intervals, and then returns to much longer duration intervals, such as one hour intervals, after the MEMS sensor comes to rest.

Figure 2:
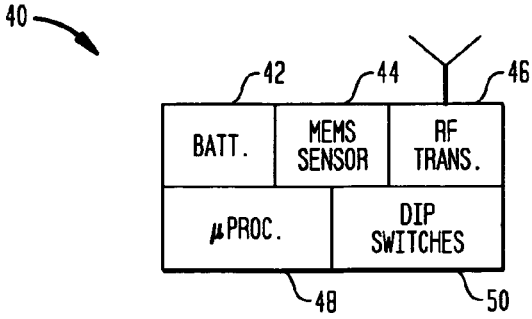
FIG. 2 illustrates a MEMS sensor unit of the present invention that includes a battery power supply, a MEMS sensor, a short range RF transmitter, and a microprocessor to control operation of the MEMS sensor unit.

Referring to FIG. 2, the MEMS sensor unit 40 of the present invention is compact, typically a little over an inch square and a fraction (e.g. ⅜) of an inch thick, such that it can be provided in a small package such as a tag to be attached to an asset to be protected, such as electronic and optical equipment, objects of art, furniture, motor vehicles such as motorcycles, etc. The MEMS sensor unit preferably includes a battery power supply 42, a MEMS sensor 44, a short range RF transmitter or transceiver 46, and a microprocessor 48 or controller or logic circuitry to control operation of the MEMS sensor unit. An RF transceiver includes both an RF transmitter and an RF receiver, while an RF transmitter is not necessarily an RF transceiver, and an RF receiver is also not necessarily an RF transceiver. The MEMS sensor unit requires a short range RF transmitter, while some embodiments might incorporate an RF transceiver 46 to enable the MEMS sensor unit to also utilize the RF receiver to receive RF signals.

The microprocessor or controller is preferably programmable or includes programmable logic to allow a relatively untrained person to program the MEMS sensor unit, such as to allow an installer to set different sensitivity levels or different transmission intervals, such as by DIP switches 50 or a jumper.

The MEMS sensor unit can measure motion along one or more axes, the rate of change or acceleration of motion along the one or more axes, and the time duration of the movement, to provide different levels of security dependent upon the type of motion and the duration of the motion which is an indication of the distance over which the sensor is being moved.

The MEMS sensor unit of the present invention can be an added sensor to a family of security sensors as are typically used in a wireless security system, such as perimeter intrusion sensors, motion sensors, etc.

The security control system/panel can have an armed state and an unarmed state, to allow different day and night security zones, and the security control system can trigger an alarm condition differently depending upon its present armed or unarmed state. For instance, in an armed state, any movement whatsoever sensed by the MEMS sensor can immediately trigger an alarm condition, whereas in an unarmed state, the security control system might allow a given amount of movement prior to triggering an alarm condition, for instance to allow electronic equipment to be moved from one conference room to another conference room without triggering an alarm condition.

In an exemplary embodiment, a MEMS sensor unit, including a MEMS sensor and a transmitter is attached to a commercial asset to be protected, such as an expensive projector of a company protected by a security system.

Initially, the MEMS sensor unit is in a power conservation, normal supervision mode in which the MEMS sensor unit transmits a narrow band, short range, normal status RF signal on a very infrequent normal supervision interval, such as once every hour.

Upon sensing motion, the MEMS sensor unit immediately transmits a motion signal to the security system receiver indicating that the MEMS sensor unit and attached asset have been moved.

After this has occurred, the MEMS sensor unit starts sending supervision signals on a more frequent basis, such as once every minute to the security system receiver.

After the asset attached to the MEMS sensor unit is returned to a stationary state or condition, the MEMS sensor unit transmits a stationary signal to the security system receiver indicating the return to a stationary state.

At this time, the MEMS sensor unit returns to the power conservation, normal supervision interval, transmitting a normal status signal on a very infrequent normal supervision interval, such as once every hour Should the MEMS sensor unit be moved out of range of the security system receiver before the stationary message is received, as indicated by the security system receiver not receiving one or more of the frequent supervision signals, the security control system indicates an alarm condition.

While several embodiments and variations of the present invention for a MEMS sensor for security applications are described in detail herein, it should be apparent that the disclosure and teachings of the present invention will suggest many alternative designs to those skilled in the art.

I claim:

1. A MEMS (micro-electronic mechanical system) sensor unit, for a security system having an RF receiver, that provides both an immediate alarm signal upon detection of motion as well as an out of range condition, comprising:

a battery power supply, a MEMS sensor, a short range RF transmitter, and a controller to control operation of the MEMS sensor unit;

wherein initially the MEMS sensor unit is in a power conservation, normal supervision mode in which the MEMS sensor unit transmits a normal status RF signal to the security system receiver on an infrequent normal supervision interval;

upon sensing motion, the MEMS sensor unit transmits a motion signal to the security system receiver indicating that the MEMS sensor unit has been moved, and then sends supervision signals to the security system receiver on a more frequent interval than the normal supervision interval;

after the MEMS sensor unit senses that it has returned to a stationary state, the MEMS sensor unit transmits a stationary signal to the security system receiver indicating the return to a stationary state, and the MEMS sensor unit then returns to the normal supervision mode, transmitting a normal status signal on an infrequent normal supervision interval;

if the MEMS sensor unit is moved out of range of the security system receiver before the stationary message is received by the security system receiver, as indicated by the security system receiver not receiving one or more of the frequent supervision signals, the security system indicates an alarm condition.

2. The MEMS sensor unit of claim 1, wherein the MEMS sensor unit transmits the normal status RF signal to the RF receiver on an infrequent normal supervision interval of approximately once every hour.

3. The MEMS sensor unit of claim 1, wherein the MEMS sensor unit transmits the supervision signals to the RF receiver on a more frequent interval of approximately once every minute.

4. The MEMS sensor unit of claim 1, wherein the controller is programmable to allow an installer to set different sensitivity levels for the MEMS sensor unit.

5. The MEMS sensor unit of claim 1, wherein the controller is programmable to allow an installer to set different transmission intervals for the MEMS sensor unit.

6. The MEMS sensor unit of claim 1, wherein the security system has an armed state and an unarmed state, and the security system triggers an alarm condition differently depending upon its present armed or unarmed state.

7. The MEMS sensor unit of claim 1, wherein the MEMS sensor unit measures motion and the rate of change of motion along one or more axes, and the time duration of the motion, to provide different levels of security dependent upon the type of and duration of the motion.

8. The MEMS sensor unit of claim 1, wherein the MEMS sensor unit includes an RF transceiver that includes the RF transmitter and an RF receiver.

9. A method of operating a MEMS (micro-electronic mechanical system) sensor unit, for a security system having an RF receiver, that provides both an immediate alarm signal upon detection of motion as well as an out of range condition, comprising:

providing a MEMS sensor unit including a battery power supply, a MEMS sensor, a short range RF transmitter, and a controller to control operation of the MEMS sensor unit;

initially placing the MEMS sensor unit is in a power conservation, normal supervision mode with the MEMS sensor unit transmitting a normal status RF signal to the security system receiver on an infrequent normal supervision interval;

upon sensing motion, the MEMS sensor unit transmitting a motion signal to the security system receiver indicating that the MEMS sensor unit has been moved, and then sending supervision signals to the security system receiver on a more frequent interval than the normal supervision interval;

after the MEMS sensor unit senses that it has returned to a stationary state, the MEMS sensor unit transmitting a stationary signal to the security system receiver indicating the return to a stationary state, and the MEMS sensor unit then returning to the normal supervision mode, transmitting a normal status signal on an infrequent normal supervision interval;

if the MEMS sensor unit is moved out of range of the security system receiver before the stationary message is received by the security system receiver, as indicated by the security system receiver not receiving one or more of the frequent supervision signals, the security system indicating an alarm condition.

10. The method of claim 9, the MEMS sensor unit transmitting the normal status RF signal to the RF receiver on an infrequent normal supervision interval of approximately once every hour.

11. The method of claim 9, the MEMS sensor unit transmitting the supervision signals to the RF receiver on a more frequent interval of approximately once every minute.

12. The method of claim 9, including an installer programming the controller to set different sensitivity levels for the MEMS sensor unit.

13. The method of claim 9, including an installer programming the controller to set different transmission intervals for the MEMS sensor unit.

14. The method of claim 9, the security system having an armed state and an unarmed state, and the security system triggering an alarm condition differently depending upon its present armed or unarmed state.

15. The method of claim 9, the MEMS sensor unit measuring motion and the rate of change of motion along one or more axes, and the time duration of the motion, and providing different levels of security dependent upon the type of and duration of the motion.

* * * * *